United States Patent [19]

Yagi et al.

[11] 4,046,705

[45] Sept. 6, 1977

[54] STABLE BLEACHING DETERGENT COMPOSITION

[75] Inventors: Kouichi Yagi, Tokyo; Makoto Yamanaka, Koganei; Takashi Fujino, Yokohama, all of Japan

[73] Assignee: Kao Soap Co., Ltd., Tokyo, Japan

[21] Appl. No.: 688,531

[22] Filed: May 21, 1976

[30] Foreign Application Priority Data

June 4, 1975 Japan ..... 50-67268

[51] Int. Cl.[2] ..... C11D 7/18; C11D 7/56

[52] U.S. Cl. ..... 252/99; 252/89 R; 252/102; 252/186; 8/111

[58] Field of Search ..... 252/94, 99, 89, 102, 252/186; 8/111

[56] References Cited

U.S. PATENT DOCUMENTS 3,816,324 6/1974 Fine et al. ..... 252/99

*Primary Examiner*—Mayer Weinblatt

*Attorney, Agent, or Firm*—Blanchard, Flynn, Thiel, Boutell & Tanis

[57] ABSTRACT

A stable bleaching detergent composition comprising an inorganic peroxide and a compound having the formula:

wherein $R_1$ is hydrogen or alkyl having 1 to 3 carbon atoms, is a radical of an unsaturated 5 member or 6 member heterocyclic ring system containing only nitrogen and carbon atoms in the ring, which can be fused to a benzene ring or another heterocyclic ring to give a polycyclic radical, $R_2$ is hydrogen or substituted or unsubstituted alkyl having 1 to 10 carbon atoms, substituted or unsubstituted phenyl, pyridyl or pyrrolidone group, $R_3$ is hydrogen, substituted or unsubstituted alkyl, phenyl, alkoxy, phenoxy, amino, acyloxy, carbamoyl or acyl group or halogen, or $R_3$ may form together with $R_4$ a benzo radical, and $R_4$ is hydrogen or a monovalent group $-R_5Y$ in which $R_5$ is alkylene or alkylidene having 1 to 6 carbon atoms or a phenylene group and Y is a group corresponding to the residue of the above general formula from which $R_4$ has been removed, or $R_4$ may form a benzo group together with $R_3$.

7 Claims, No Drawings

STABLE BLEACHING DETERGENT COMPOSITION

BACKGROUND OF THE INVENTION

1. FIELD OF THE INVENTION

The present invention relates to a bleaching detergent composition which possesses excellent storage stability. More particularly, the invention relates to a powder bleaching detergent composition containing an inorganic peroxide stably incorporated therein.

2. DESCRIPTION OF THE PRIOR ART

Inorganic peroxides such as sodium percarbonate and sodium perborate are very valuable household and industrial bleaching agents. It is known to add such an inorganic peroxide to a detergent composition as one component for imparting a bleaching capability to the detergent composition. However, when most of these inorganic peroxides are incorporated into powdery detergents, they decompose rapidly and such compositions are not satisfactory for practical use. Especially in relatively hot and humid summer climate conditions, such as in Japan, (for example, 30° C and 80% RH), inorganic peroxides drastically decompose during storage and detergents containing these inorganic peroxides fail to exhibit a sufficient bleaching effect.

Various studies have heretofore been made with a view to developing stabilizers or methods of stabilizing peroxide bleaching compounds in order to overcome these disadvantages. As a method that provides a high effect of inhibiting or controlling the decomposition of inorganic peroxides, there can be mentioned a method in which a chelating agent capable of forming a metal chelate compound which is readily soluble in water, such as nitrilotriacetate (NTA) or ethylenediamine tetraacetate (EDTA), is added to an inorganic peroxide-containing detergent. As another method that provides a higher decomposition-inhibiting effect than the above-mentioned method, there can be mentioned a method in which a chelating agent capable of forming a poorly water-soluble or a water-insoluble metal chelate compound, such as salicylaldoxime or α-benzoinoxime, is added to an inorganic peroxide-containing detergent.

According to these methods, however, a satisfactory storage stability cannot be obtained, and the inorganic peroxide contained in the detergent decomposes in a relatively short time. Further, when a chelating agent such as those mentioned above is incorporated into a powdery detergent, it tints the detergent to a light orange or violet color and, thus, detrimentally affects the desired normal pure white appearance of the detergent.

SUMMARY OF THE INVENTION

We have discovered a bleaching detergent composition that overcomes the foregoing problems and has an excellent stability. More specifically, the present invention provides a stable bleaching detergent composition characterized in that a compound having the formula (I) is added together with an inorganic peroxide to any conventional compatible powdery detergent composition:

(I)

-continued

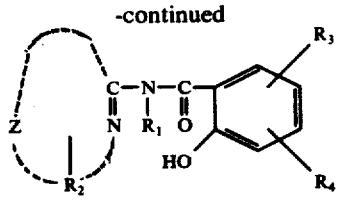

wherein $R_1$ is hydrogen or alkyl having 1 to 3 carbons;

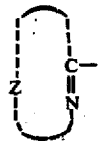

is a monovalent radical of an unsaturated 5 member or 6 member heterocyclic ring containing only nitrogen and carbon atoms in the ring, which heterocyclic ring can be fused to a benzene ring or another heterocyclic ring to give a polycyclic radical having the characteristic

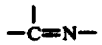

grouping; $R_2$ is hydrogen, or substituted or unsubstituted alkyl having 1 to 10 carbon atoms, or substituted or unsubstituted phenyl, or pyridyl or oxopyrrolidinyl; $R_3$ is hydrogen, substituted or unsubstituted alkyl having 1 to 22 carbons, phenyl or substituted phenyls, alkoxy, phenoxy, amino, acyloxy, carbamoyl, acyl or halogen, or $R_3$ may form together with $R_4$ a benzo group; and $R_4$ is hydrogen or a monovalent group $-R_5Y$ in which $R_5$ is alkylene or alkylidene group having 1 to 6 carbon atoms or a phenylene group and Y is a group corresponding to a radical obtained by removing $R_4$ from a compound of formula (I), or $R_4$ together with $R_3$ can form a benzo group.

As specific examples of the 5- or 6-membered heterocyclic ring in the above formula (I), there can be mentioned triazole, triazine, tetrazole, tetrazine, imidazole, benzoimidazole, indazole, imidazoline, indolenine (ψ-indole or pseudo indole), pyrazole, benzopyrazole, pyrazoline, pyrazine, pyridazine, pyrimidine, 5-pyrazolone, quinoline and quinazoline. As specific examples of the substituent $R_2$ of the heterocyclic ring, there can be mentioned alkyls having 1 to 10 carbons such as methyl, ethyl, isopropyl and nonyl, alkyl having 1 to 10 carbons substituted with hydroxy, chloro, amino, alkoxy ($C_1$ to $C_{10}$), phenoxy, phenyl, hydroxyphenyl and benzoylamino such as hydroxyethyl, chloromethyl, aminomethyl, butyroxyethyl, ethoxyethyl, phenoxymethyl, phenylmethyl, p-hydroxyphenylethyl and benzoylaminomethyl, phenyl, phenyl substituted with one or two alkyls ($C_1$ to $C_2$), chloro, hydroxy, alkoxy ($C_1$ to $C_{10}$), acyloxy ($C_1$ to $C_4$) and amino, such as toluyl, monochlorophenyl, hydroxyphenyl, alkoxy ($C_1$–$C_{10}$) phenyl, acyloxy ($C_1$–$C_4$) phenyl and aminophenyl, aroyl having 6 to 8 carbons such as xylenoyl, pyridyl and oxopyrrolidinyl.

As specific examples of the substituent $R_3$ of above general formula (I), there can be mentioned alkyls having one to 22 carbons such as methyl, ethyl, propyl, isopropyl, butyl, hexyl, 2-ethylhexyl, isodecyl, lauryl, palmityl and stearyl, alkyls having one to 22 carbons substituted with hydroxy, chloro, alkoxy ($C_1$ to $C_4$), phenoxy, phenyl and amino such as hydroxymethyl, ethoxyethyl, chloromethyl, phenoxymethyl, aminomethyl and phenylmethyl, phenyl, phenyl substituted with one or 2 alkyls having one or 2 carbons or alkoxy ($C_1$ to $C_{10}$) such as toluyl, aroyl having 6 to 8 carbons such as xylenoyl, alkoxy having 1 to 10 carbons such as methoxy, butoxy, phenylmethoxy and octyloxy, halogens such as chlorine and bromine, alkylamino ($C_1$ to $C_{10}$) such as ethylamino, aminosulfonamido, alkanoyloxy ($C_2$ to $C_6$) such as acetoxy, aroyloxy ($C_6$–$C_8$) such as benzoxy, carbamoyl, alkoxy ($C_1$ to $C_{10}$) carbonyl such as methoxycarbonyl and octyloxycarbonyl and aryl ($C_6$ to $C_8$) oxycarbonyl such as phenoxycarbonyl. The case where $R_3$ and $R_4$ together form a benzo group signifies a compound in which a naphthalene nucleus is present instead of the benzene nucleus in the above formula (I), and the case where $R_4$ is a group $-R_5Y$ signifies a compound in which two molecules of the compound of the formula (I) are bonded together through an alkylene, alkylidene or phenylene group.

When the compound of formula (I) is incorporated in an amount of 0.001 to 5 parts by weight, preferably 0.01 to 3 parts by weight, per 100 parts by weight of the powdery bleaching detergent, the stability of the inorganic peroxide present in the composition is highly improved and reduction of the available oxygen content by decomposition of the inorganic peroxide during storage can be effectively prevented and an excellent bleaching effect can be maintained for a long time. Still further, the powdery detergent is not colored at all by incorporation of the compound of formula (I) and the powdery detergent retains a good white appearance.

As the inorganic peroxide that can be used in the present invention, there can be mentioned peroxides and hydrogen peroxide adducts of carbonates, borates, phosphates, sulfates and silicates (sodium salts are especially preferred). As specific examples, there can be mentioned sodium percarbonate ($2Na_2CO_3.3H_2O_2$), sodium perborate ($NaBO_3.4H_2O_2$), sodium peroxypyrophosphate ($Na_4P_2O_7.3H_2O_2$) and sodium peroxytripolyphosphate. The amount of the inorganic peroxide is determined appropriately depending on the kind of the inorganic peroxide used and the intended use, but in general, the inorganic peroxide is incorporated in the detergent composition in an amount of 1 to 50% by weight, preferably 5 to 30% by weight, based on the total weight of the bleaching detergent composition.

As the organic surfactant that acts as the principal active detergent component of the bleaching detergent composition of the present invention, there can be used the conventional water-soluble anionic, nonionic and amphoteric surfactants, and mixtures thereof, that are known for use in washing detergent compositions. In some special cases, small amounts of cationic surfactants can also be employed. The amount incorporated of the surfactant is generally 1 to 30% by weight, based on the total weight of the bleaching detergent composition. Further, according to the intended object and use, inorganic builders such as sodium tripolyphosphate, sodium sulfate, sodium silicate and sodium carbonate, anti-redeposition agents such as carboxymethyl cellulose, polyvinylpyrrolidone and polyethylene glycol, and inorganic peroxide-activating agents such as N-acyl compounds and organic acid anhydrides can be incorporated in the conventional amounts. In addition, enzymes, antioxidants, fluorescent whitening agents and perfumes may be incorporated.

The present invention will now be further described by reference to the following illustrative Examples.

EXAMPLE 1

A powder bleaching detergent was prepared by incorporating 10 parts by weight of an inorganic peroxide indicated below into 90 parts by weight of a detergent composition containing ether a known chelating agent or a compound of the formula (I) and having the composition indicated below. The thus-prepared bleaching detergent composition was allowed to stand still at a temperature of 30° C and a relative humidity of 80% for 30 days. Then the concentration of the remaining available oxygen was measured. The residual activity is expressed in terms of the percent of the remaining available oxygen concentration based on the initial available oxygen concentration. The results are shown in Table 1.

| Composition of detergent: | parts by weight |
|---|---|
| Sodium alkylbenzenesulfonate (average carbon number = 12) | 20.0 |
| Sodium tripolyphosphate | 20.0 |
| Sodium silicate | 8.0 |
| Sodium carbonate | 1.0 |
| Carboxymethyl cellulose | 1.0 |
| Chelating agent (indicated in Table 1) | 1.0 |
| Fluorescent whitening agent and perfume | 0.7 |
| Sodium sulfate | 38.3 |
| Water | 10.0 |

Each of the ingredients used was of the industrial grade.

Table 1

| Chelating Compound | Residual Activity (% of original available oxygen) | | |
|---|---|---|---|
| | Sodium Percarbonate | Sodium Perborate | Sodium Peroxypyrophosphate |
| Comparative Runs | | | |
| Not added | 25 | 75 | 15 |
| NTA[1)] | 40 | 80 | 27 |
| EDTA[2)] | 38 | — | — |
| Salicylaldoxime[3)] | 62 | 86 | 34 |
| α-Benzoinoxime[4)] | 53 | — | — |
| Runs of Present Invention | | | |
| 3-Salicyloylamido-1,2,4-triazole[5)] | 80 | 95 | 62 |
| 5-Ethyl-3-salicyloylamido-1,2,4-triazole[6)] | 82 | 96 | 60 |
| 3-(5-Methylsalicyloyl)amido-1,2,4-triazole[7)] | 81 | 93 | 57 |
| 5-Pyridyl-3-salicyloylamido-1,2,4-triazole[8)] | 76 | 90 | 54 |
| 3-(2-Hydroxy-3-naphthoyl)amido-1,2,4-triazole[9)] | 70 | 93 | 55 |
| 3-Salicyloylamido-benzoimidazole[10)] | 71 | 92 | 60 |

Notes:

Table 1-continued
| Chelating Compound | Residual Activity (% of original available oxygen) | | |
|---|---|---|---|
| | Sodium Percarbonate | Sodium Perborate | Sodium Peroxypyrophosphate |
| 1) 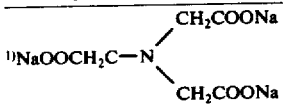 | | | |
| 2) 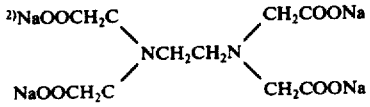 | | | |
| 3) 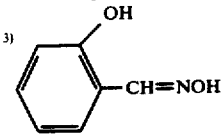 | | | |
| 4) 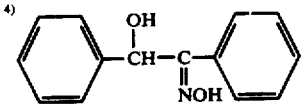 | | | |
| 5) 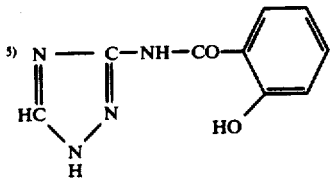 | | | |
| 6) 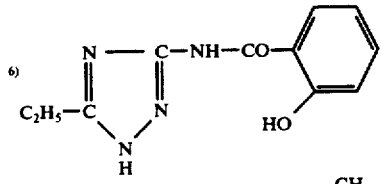 | | | |
| 7) 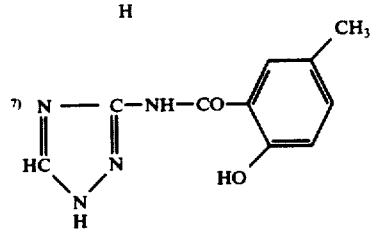 | | | |
| 8) 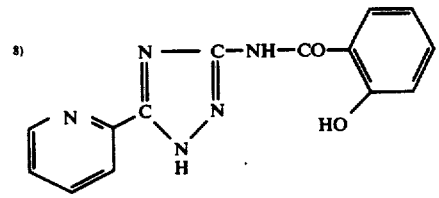 | | | |
| 9) 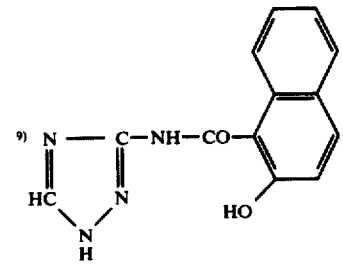 | | | |
| 10) 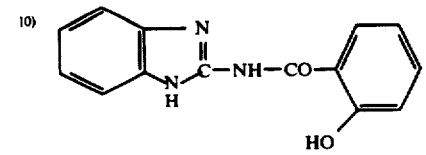 | | | |

As will be apparent from the results shown in Table 1, when no chelating agent is incorporated, the inorganic peroxides, especially sodium percarbonate and sodium peroxypyrophosphate, in the detergents were very unstable and substantially decomposed during storage. On the other hand, in the bleaching detergent compositions of the present invention, the storage stability is highly improved and this improved storage stability is much superior to that of comparative compositions including a known chelating agent.

EXAMPLE 2

According to the same method as described in Example 1, the storage stabilities of various inorganic peroxides in detergents including a compound of formula (I) were examined. The results shown in Table 2 were obtained.

Table 2

| Chelating Compound | Residual Activity (% of original available oxygen) | | |
|---|---|---|---|
| | Sodium Percarbonate | Sodium Perborate | Sodium Peroxypyrophosphate |
| 4-Salicyloylamido-1,2,3-triazole[1)] | 71 | 90 | 48 |
| 5-Salicyloylamido-1,2,3,4-tetrazole[2)] | 76 | 93 | 52 |
| 2-Salicyloylamido-1,3-imidazole[3)] | 68 | 86 | 47 |
| 3-Salicyloylamido-1,2,4-triazine[4)] | 72 | 88 | 49 |
| 2-Salicyloylamido-1,3,5-triazine[5)] | 75 | 91 | 51 |
| 3-Salicyloylamido-1,2-pyrazole[6)] | 70 | 90 | 46 |
| 3-Salicyloylamido-1,2-benzopyrazole[7)] | 78 | 92 | 54 |
| 3-(5-Octylsalicyloyl)amido-1,2,4-triazole[8)] | 74 | 91 | 52 |
| 3-(5-Phenylsalicyloyl)amido-1,2,4-triazole[9)] | 80 | 94 | 55 |
| 3-(5-Butoxysalicyloyl)amido-1,2,4-triazole[10)] | 73 | 87 | 43 |
| 3-(5-Octoxysalicyloyl)amido-1,2,4-triazole[11)] | 81 | 93 | 52 |
| 3-(5-Ethylaminosalicyloyl)amido-1,2,4-triazole[12)] | 79 | 90 | 50 |
| 3-(5-Acetoxysalicyloyl)amido-1,2,4-triazole[13)] | 75 | 89 | 49 |
| 3-(5-Octoxyacylsalicyloyl)amido-1,2,4-triazole[14)] | 83 | 92 | 52 |
| 3-(5-Benzoxysalicyloyl)amido-1,2,4-triazole[15)] | 80 | 90 | 51 |
| 3-(5-Phenoxysalicyloyl)amido-1,2,4-triazole[16)] | 76 | 88 | 48 |
| 5,5'-methylene-bis(5-methyl-3-salicyloyl-amido-1,2,4-triazole)[17)] | 81 | 95 | 56 |
| 3-(3-Chlorosalicyloyl)amido-1,2,4-triazole[18)] | 78 | 88 | 50 |
| 5-Octyl-3-salicyloylamido-1,2,4-triazole[19)] | 80 | 92 | 55 |

Notes:

1)
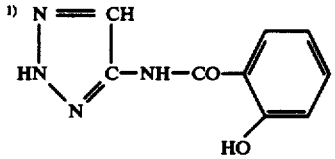

2)
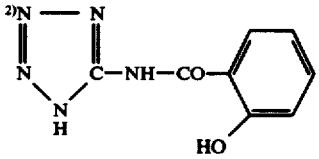

3)
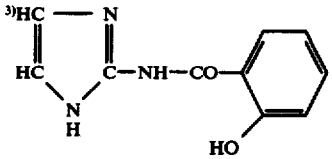

4)
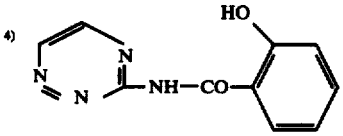

5)
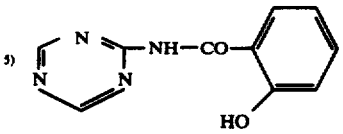

6)
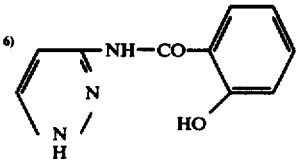

Table 2-continued
| Chelating Compound | Residual Activity (% of original available oxygen) | | |
|---|---|---|---|
| | Sodium Percarbonate | Sodium Perborate | Sodium Peroxypyrophosphate |
| 7) 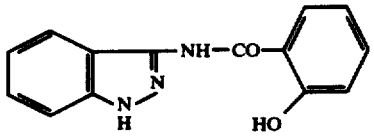 | | | |
| 8) 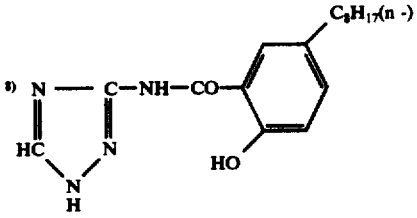 | | | |
| 9) 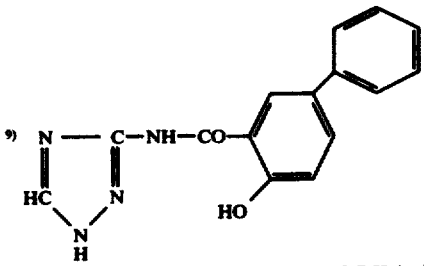 | | | |
| 10) 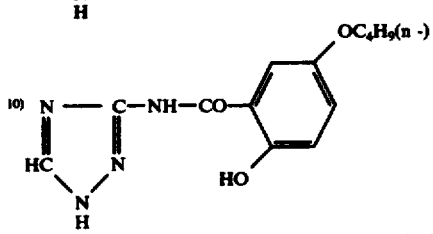 | | | |
| 11) 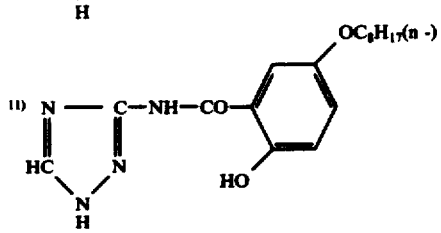 | | | |
| 12) 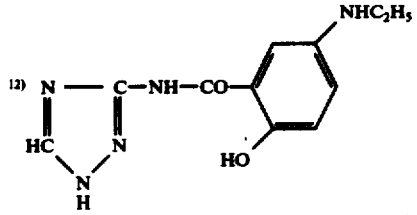 | | | |
| 13) 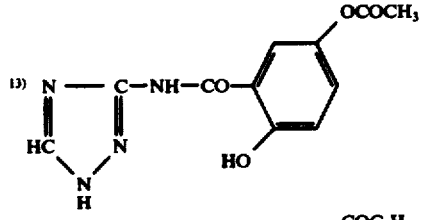 | | | |
| 14) 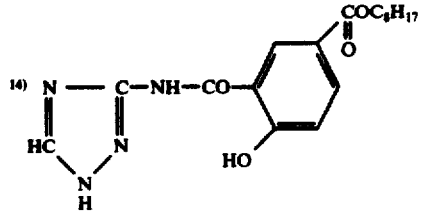 | | | |

Table 2-continued

| Chelating Compound | Residual Activity (% of original available oxygen) | | |
|---|---|---|---|
| | Sodium Percarbonate | Sodium Perborate | Sodium Peroxypyrophosphate |

15) 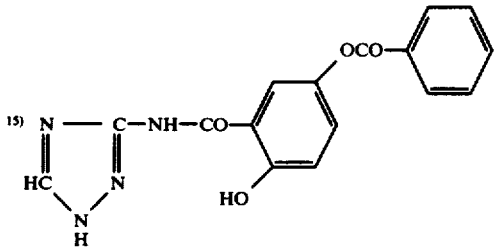

16) 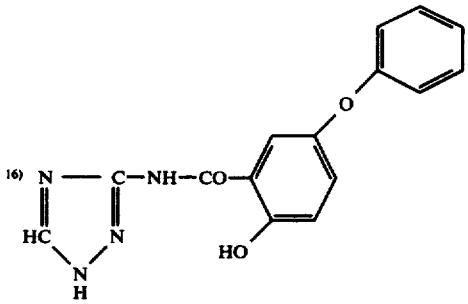

17) 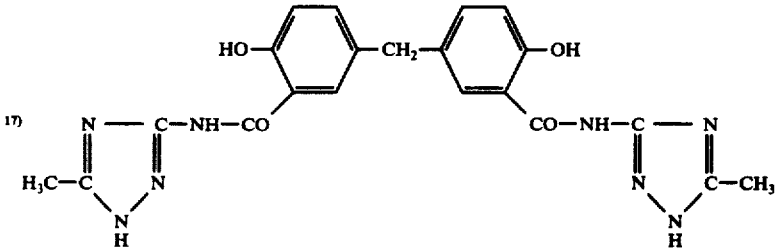

18) 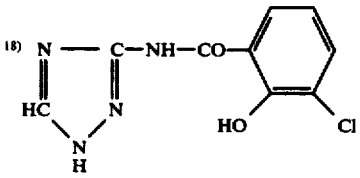

19) 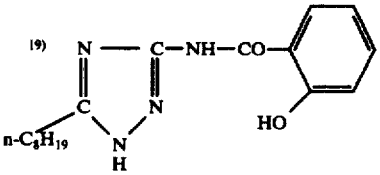

The embodiments of the invention in which an exclusive property or privilege is claimed are defined as follows:

1. A stable bleaching detergent composition, consisting essentially of:

A. from about one to about 30 percent by weight of a surfactant selected from the group consisting of water-soluble anionic surfactant, water-soluble nonionic surfactant, water-soluble amphoteric surfactant and mixtures thereof;

B. from about one to about 50 percent by weight of an inorganic peroxygen compound capable of releasing oxygen in aqueous solution;

C. the balance is a substance selected from the group consisting of water-soluble neutral inorganic builder salts, water-soluble alkaline inorganic builder salts, water-soluble organic builders and mixtures thereof; and D. from 0.001 to 5 parts by weight, per 100 parts by weight of the sum of the weights of A plus B plus C, of a compound or mixture of compounds having the formula

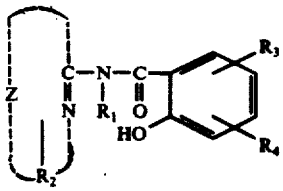

wherein $R_1$ is hydrogen or alkyl having one to 3 carbon atoms;

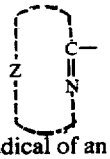

is a monovalent radical of an unsaturated 5 member or 6 member heterocyclic ring containing only nitrogen and carbon atoms in the ring, or said heterocylic ring fused to a benzene ring or another heterocyclic ring to give a polycyclic radical having the characteristic

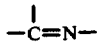

grouping; $R_2$ is hydrogen, unsubstituted alkyl having one to 10 carbon atoms, alkyl having one to 10 carbon atoms substituted with hydroxy, chloro, amino, alkoxy ($C_1$ to $C_{10}$), phenoxy, phenyl, hydroxyphenyl or benzoylamino, unsubstituted phenyl, phenyl substituted with one or two alkyls ($C_1$ to $C_2$), chloro, hydroxy, alkoxy ($C_1$ to $C_{10}$), acyloxy ($C_1$ to $C_4$) or amino, aroyl having 6 to 8 carbon atoms, pyridyl or oxopyrrolidinyl; $R_3$ is hydrogen, unsubstituted alkyl having one to 22 carbon atoms, alkyl having one to 22 carbon atom substituted with hydroxy, chloro, alkoxy ($C_1$ to $C_4$), phenoxy, phenyl or amino, phenyl, phenyl substituted with one or 2 alkyls having one or 2 carbon atoms or alkoxy ($C_1$ to $C_{10}$), aroyl having 6 to 8 carbon atoms, alkoxy having one to 10 carbon atoms, phenoxy, halogen, alkylamino ($C_1$ to $C_{10}$), aminosulfonamido, alkanoyloxy ($C_2$ to $C_6$), aroyloxy ($C_6$ to $C_8$), carbamoyl, alkoxy ($C_1$ to $C_{10}$) carbonyl and aryl ($C_6$ to $C_8$) oxycarbonyl, or $R_3$ and $R_4$ together form a benzo group; and $R_4$ is hydrogen or $-R_5Y$, in which $R_5$ is alkylene having one to 6 carbons, alkylidene having one to 6 carbons or phenylene, and Y is a radical obtained by removing $R_4$ from a compound of said formula.

2. A composition as claimed in claim 1 in which the amount of B is from 5 to 30 percent by weight and the amount of D is from 0.01 to 3 parts by weight, per 100 parts by weight of the sum of the weights of A plus B plus C.

3. A composition as claimed in claim 1 in which said peroxygen compound is selected from the group consisting of peroxides and hydrogen peroxide adducts of water-soluble carbonates, borates, phosphates, sulfates, and silicates.

4. A composition as claimed in claim 1 in which said peroxygen compound is selected from the group consisting of sodium percarbonate, sodium perborate, sodium peroxypyrophosphate and sodium peroxytripolyphosphate.

5. A composition as claimed in claim 1 in which said peroxygen compound is sodium percarbonate.

6. A composition as claimed in claim 1 in which

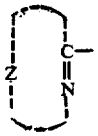

is a radical of a heterocyclic ring selected from the group consisting of triazole, triazine, tetrazole, tetrazine, imidazole, benzoimidazole, indazole, imidazoline, pyrazole, benzopyrazole, 5-pyrazolone, pyrazine, pyridazine, pyrimidine, quinoline, indolenine, pyrazoline, and quinazoline.

7. A composition as claimed in claim 1 in which

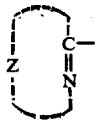

is a radical of triazole.

* * * * *